United States Patent [19]

Gillet

[11] Patent Number: 4,549,182

[45] Date of Patent: Oct. 22, 1985

[54] SYSTEM FOR ENCOURAGING THE RETURN OF VEHICLES SUCH AS TROLLEYS

[75] Inventor: Guy Gillet, Deols, France

[73] Assignee: Supermarket Systems, Paris, France

[21] Appl. No.: 424,781

[22] Filed: Sep. 27, 1982

[30] Foreign Application Priority Data

Jun. 21, 1982 [FR] France ..... 82 10826

[51] Int. Cl.[4] ..... G08G 1/00

[52] U.S. Cl. ..... 340/942; 194/4 C; 340/933

[58] Field of Search ..... 340/51, 539, 568, 928, 340/933, 942, 323 R, 550, 555; 194/4 R, 4 B, 4 C; 307/112; 250/221

[56] References Cited

U.S. PATENT DOCUMENTS

| | | | |
|---|---|---|---|
| 2,653,309 | 9/1953 | Hausz | 340/323 R |
| 3,532,886 | 10/1970 | Kruger | 340/933 |
| 3,663,936 | 5/1972 | Boudouris | 340/928 |
| 3,705,976 | 12/1972 | Platzman | 340/933 |
| 3,766,363 | 10/1973 | Dhooge | 340/51 |
| 3,794,966 | 2/1974 | Platzman | 340/928 |
| 3,882,982 | 5/1975 | Smith | 221/3 |
| 3,890,463 | 6/1975 | Ikegami | 340/323 R |
| 3,938,638 | 2/1976 | Moule | 194/4 C |
| 3,978,959 | 9/1976 | Muellner | 194/4 R |
| 4,327,819 | 5/1982 | Coutta | 340/568 |
| 4,338,594 | 7/1982 | Holm | 340/568 |
| 4,377,227 | 3/1983 | Sandford | 194/4 R |
| 4,403,142 | 9/1983 | Kondo | 340/555 |
| 4,424,893 | 1/1984 | Gillet | 194/4 C |

*Primary Examiner*—John W. Caldwell, Sr.
*Assistant Examiner*—Michael F. Heim
*Attorney, Agent, or Firm*—Pollock, Vande Sande & Priddy

[57] ABSTRACT

Users need to be encouraged to return vehicles such as airport baggage trolleys or supermarket trolleys to a vehicle storage area. The area is equipped with an entrance fitted with a system for dispensing a reward for each vehicle returned to the area. The system comprises detector means (16, 17) for detecting the presence of a vehicle at the entrance to the storage area, control means for determining whether a vehicle has been effectively returned (and not just passed back-and-forth past the detector means), and means (23) for dispensing a reward such as a ticket exchangeable for a benefit of some kind for each returned vehicle. Said detector means comprise two detectors which are disposed in line along a vehicle return path at said entrance and which are so spaced relative to each other as to be capable of being triggered simultaneously by a single member of a vehicle as said vehicle is moved along said path past said detector means, whereby the direction of vehicle movement past the detector means can be determined by the control means.

10 Claims, 9 Drawing Figures

SYSTEM FOR ENCOURAGING THE RETURN OF VEHICLES SUCH AS TROLLEYS

The invention relates to a system for encouraging users to return vehicles such as trolleys, eg. of the kind provided in railway stations or airports for transporting baggage, or in supermarkets for transporting purchases made by customers, etc.

BACKGROUND OF THE INVENTION

Users often abandon such trolleys after use at a considerable distance from the point at which they were taken. It is then necessary to find the trolleys and to return them to a starting point where they are again left at the disposition of travellers or customers. This can be relatively expensive. It can also happen that trolleys are not found, or that they are found damaged.

Systems have already been proposed to encourage users to return such trolleys after use. These systems are generally located at the entrance to a trolley storage or collecting area, and comprise means for detecting the presence of a trolley at the entrance to the collecting area, and means for dispensing some kind of reward when a trolley is effectively returned.

Naturally, it is necessary to prevent such a system from dispensing a reward in the event of a fraud or an attempted fraud, for example of the kind in which a person moves a trolley back and forth past a trolley detector to simulate the return of a large number of trolleys in order to obtain a corresponding number of rewards. However, presently known systems that are immune to such frauds are relative complex and expensive.

Preferred embodiments of the present invention provide a system of the type described above for encouraging users to return vehicles such as trolleys, but in which the system is less complex than prior systems and is therefore capable of being made more cheaply, while nevertheless providing a high degree of security against attempted frauds.

SUMMARY OF THE INVENTION

The present invention provides a system for encouraging users to return vehicles such as trolleys to a vehicle storage area having an entrance fitted with said system, the system comprising detector means for detecting the presence of a vehicle at the entrance to the storage area, and means for dispensing a reward such as a ticket exchangeable for a benefit of some kind if a vehicle is effectively returned, while preventing said reward from being dispensed in the event of an attempted fraud or if a vehicle is removed from said storage area via said entrance thereto, wherein said detector means comprise two detectors which are disposed in line along a vehicle return path at said entrance and which are so spaced relative to each other as to be capable of responding simultaneously to a single member of a vehicle as said vehicle is moved along said path past said detector means, vehicle-detection signals from said detector means being applied to a processor circuit connected to control the dispensing of said rewards.

Thus, by suitably placing two detectors so that they are triggered in succession by said single member of a vehicle as it is returned and including a period in which both detectors are triggered simultaneously, it is possible for the detector means to determine reliably and unambiguously the direction in which the vehicle is moving. Consequently, the detector means can readily prevent a reward being dispensed if a vehicle is moved back-and-forth past the detectors. The direction of vehicle movement is readily determined because, for each direction of movement, first one detector is triggered by said member of a vehicle, then both the detectors are triggered together, then the other detector is triggered on its own.

In an advantageous embodiment of the invention, said member of a vehicle comprises at least one wheel, and both detectors are photoelectric cells placed at about the height of wheel axle above the ground and are spaced apart at a distance which is less than the diameter of said wheel whereby both detectors can be triggered simultaneously by the wheel.

Generally speaking, such vehicles have front and back wheels of the same diameter, so that the photoelectric cells are initially triggered by a front wheel going past them, and are then triggered by a back wheel going past.

Preferably, the system includes an automatic gate at said entrance to the storage area, said gate being arranged to be opened by a vehicle as it enters said storage area and to produce a gate open signal representative of said gate being opened by a vehicle, said gate being disposed downstream from said detectors in the direction of vehicle movement into said storage area at a distance such that said gate open signal is produced after a vehicle has triggered said detectors, and preferably after the vehicle's front wheel has passed the detectors and before the vehicle's rear wheel has passed them.

BRIEF DESCRIPTION OF THE DRAWINGS

An embodiment of the invention is described by way of example with reference to the accompanying drawings, in which.

MORE DETAILED DESCRIPTION

Figure 1:
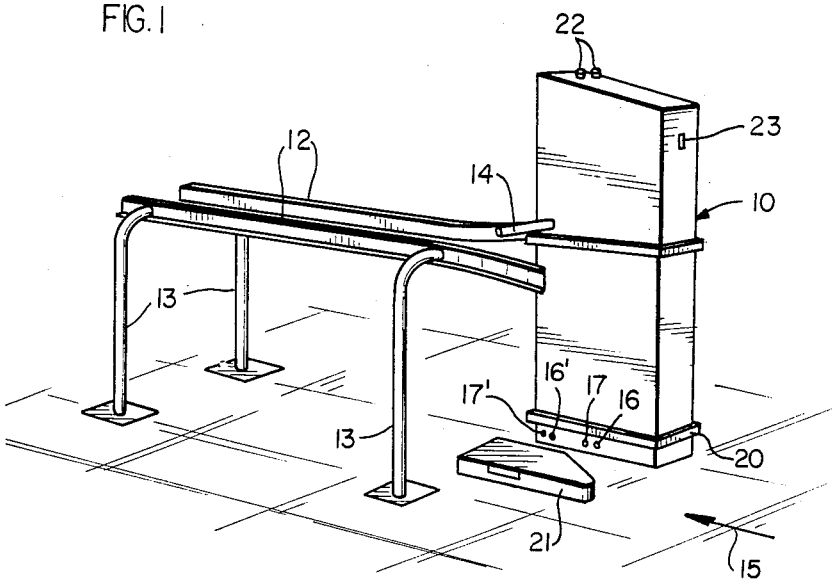
FIG. 1 is a diagrammatic perspective view of a system in accordance with the invention.
Figure 2:
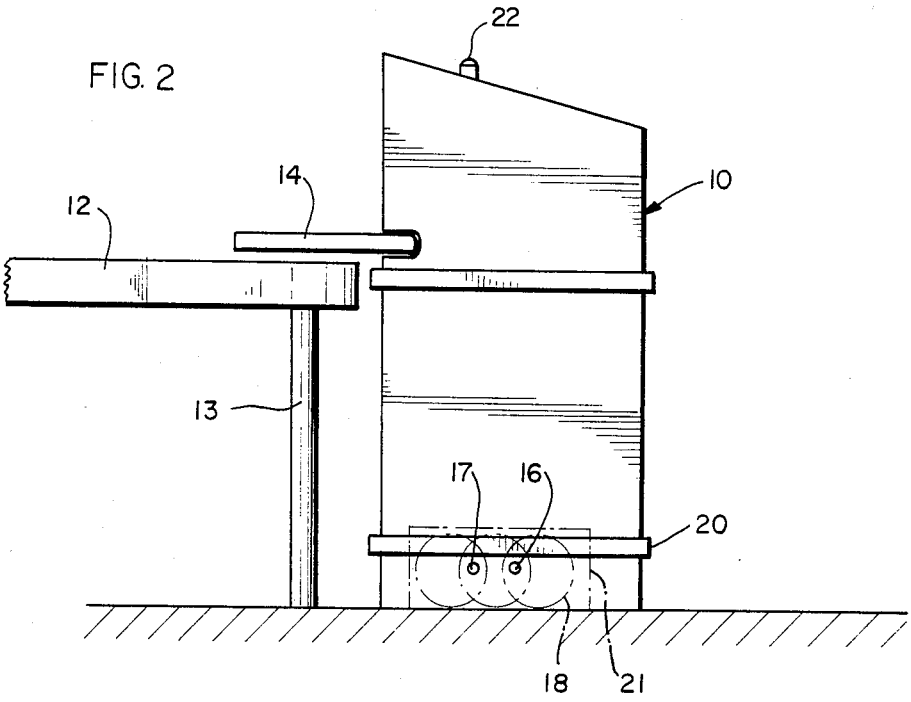
FIG. 2 is an elevation at a larger scale of the system shown in FIG. 1.

Reference is made initially to FIGS. 1 and 2, in which a system in accordance with the invention comprises a pillar 10 placed to one side of the entrance to a storage or collecting area for vehicles such as baggage trolleys or supermarket trolleys. The entrance is defined by two parallel horizontal guide rails 12 mounted on posts 13. The rails extend, in a manner not shown in the drawings, to enclose said vehicle storage area.

The pillar 10 is fitted with a turnstile type of automatic gate 14 in the form of a single horizontal bar having one end mounted on the pillar 10 and free to rotate about a vertical axis. In a normal position the gate 14 extends across the entrance to the storage area and prevents access thereto. When a trolley is returned, it is moved into the entrance to the storage area in the direction of an arrow 15, and the front of the trolley pushes against the gate 14 to cause it to swing into an open position substantially parallel to the horizontal guides 12. This position is shown in FIG. 2. Once a trolley has passed completely through the gate 14, return means (not shown) automatically return the gate 14 to its closed position.

The presence of a trolley brought up to the post 10 for return is detected by two detectors which are constituted by photoelectric detectors 16 and 17 in the illustrated example. These detectors are placed at the bottom of the pillar 10 so as to be triggered by the wheels of a trolley.

The height of the photoelectric cells above the ground is substantially equal to the radius of the wheels of the trollies to be detected (as shown by chain dotted lines referenced 18 in FIG. 2). The cells are spaced apart on a horizontal line extending parallel to the direction of trolley movement by a distance which is less than the diameter of one of the wheels 18. Immediately above the cells 16 and 17, the pillar 10 is provided with a protective belt 20 made of rubber or similar material and which serves both to protect the cell from direct collison with a trolley, and to mask the presence of the cells from the average trolley user returing a trolley.

The cells 16 and 17 are both of the send/receive type, whereby they each emit a beam of light, eg. at an infrared wavelength, in a direction substantially perpendicular to the direction of trolley movement, with said beam being reflected back to the cell or not as the case may be. The reflector may be constituted either by the wheel of a trolley when placed in front of the cell, or else by the housing 21 placed on the ground opposite to the cells 16 and 17. If the wheels act as reflectors, the presence of the wheels is detected by radiation being returned to the cells, while if the housing 21 acts as the reflector, the presence of the wheels is detected by the radiation being interrupted. In either case, a signal representative of the presence or absence of a wheel is generated.

Figure 5:
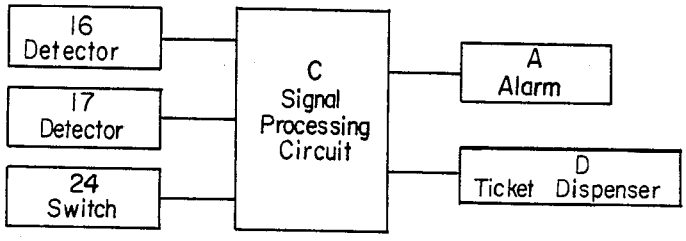
FIG. 5 is a block diagram of various components of a system in accordance with the invention.

In conventional manner the top of the pillar 10 is provided with lamps 22 to indicate whether the system is on or off, and to indicate whether it is working properly. The pillar 10 is further provided with a reward dispenser, eg. a ticket dispenser D (see FIG. 5) having an outlet slot 23 in the front face of the pillar 10.

The cells 16 and 17 together with a switch 24 actuated by the gate 14 to indicate whether the gate is open or closed, are connected to an electronic circuit C for processing signals (see FIG. 5), and outputs from the circuit control an alarm A and the ticket dispenser D.

The cells 16 and 17 are located upstream from the gate 14 in the direction of travel of a trolley being returned, and they are so spaced from said gate that the gate is opened after the front wheel or wheels have passed the cells 16 and 17, but before the back wheel or wheels have passed them.

Figure 3:
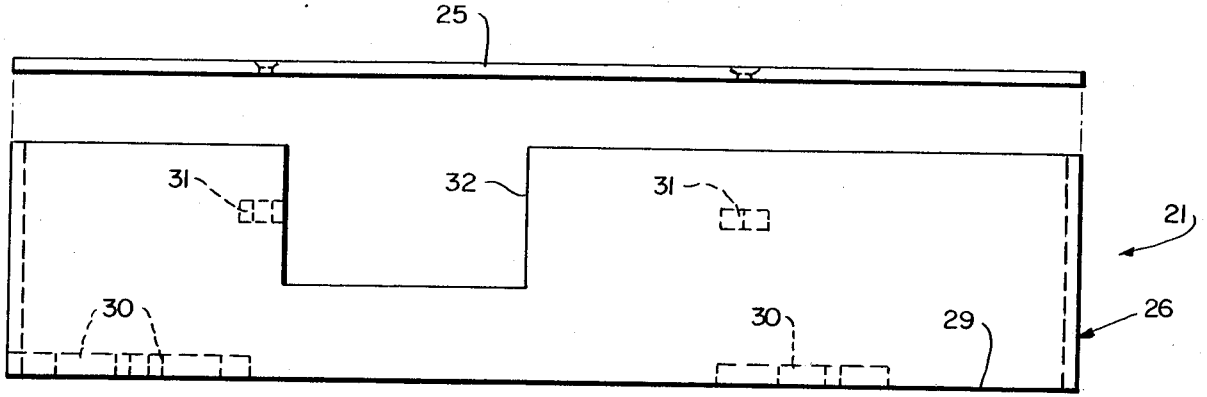
FIGS. 3 and 4 are respectively a diagrammatic elevation and plan of a floor-mounted housing placed opposite the detectors in the system shown in FIG. 1.
Figure 4:
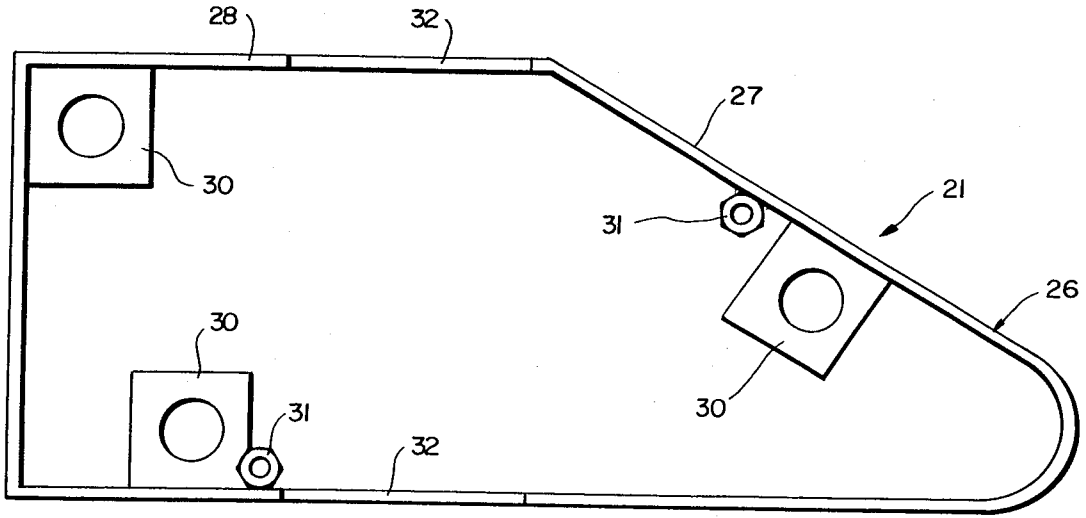

An embodiment of the housing 21 on the ground is shown in FIGS. 3 and 4. It comprises a flat lid 25 for fixing to a frame 26 having a front portion 27 which is generally triangular in shape and a back portion 28 which is substantially rectangular. The bottom edge 29 of the frame 26 has tabs 30 for fixing to the ground. Nuts 31 are welded in a horizontal position to the inside of the frame 26 in order to receive screws for fixing the lid 25 thereto. If the trolley wheels are being used as reflectors, the side walls of the frame 26 have transversely aligned slots or cutouts 32 to let the rays emitted by the cells 16 and 17 pass unhindered through the housing 21. Naturally, if the wheels serve to interrupt rays reflected from the housing 21, the cutouts 32 should be replaced by reflector surfaces.

Figure 6:
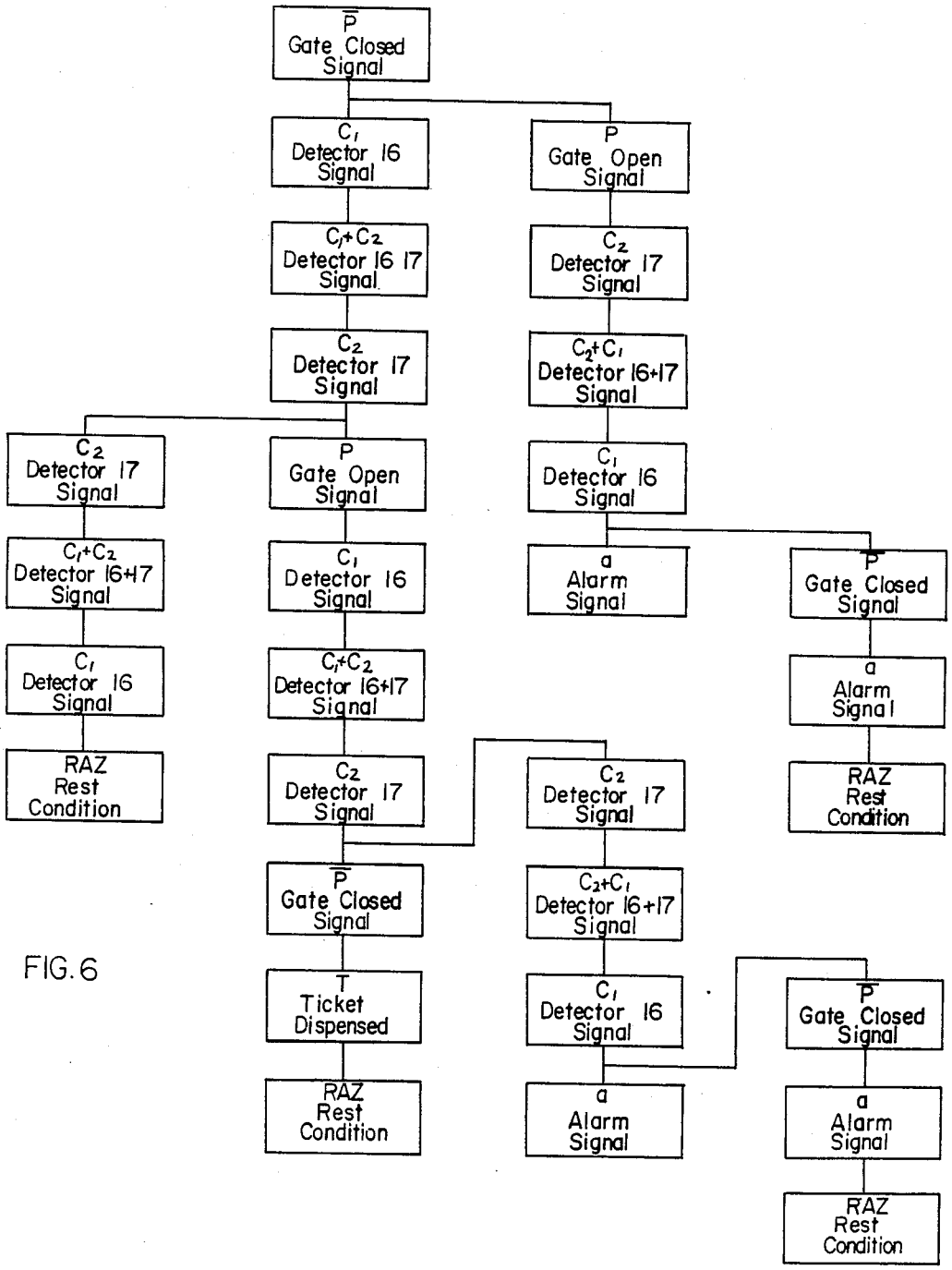
FIG. 6 is a flow chart for explaining the operation of the system.

The circuit C for processing the signals emitted by the cells 16 and 17 and by the switch 24 on the gate 14, performs the following functions which are described with reference to FIG. 6.

Suppose that the system starts from a rest condition, with no trolleys being returned to the storage area and with the gate 14 in the closed position. The associated switch 24 produces a gate-closed signal $\overline{P}$.

A trolley is then brought to the entrance to the storage area and passes in front of the cells 16 and 17 in the direction of the arrow 15 in FIG. 1. The right front wheel 18 of the trolley is initially detected by the first cell 16 on its own, thereby producing a signal $c_1$. As the trolley continues to move in the same direction, the front right wheel 18 reaches a position in which it is detected by both cells 16 and 17, so that the second cell 17 produces a signal $c_2$ while the first cell is still producing the signal $c_1$. This stage is represented by $c_1+c_2$ in FIG. 6. As the trolley continues to move in the same direction, the front right wheel 18 moves beyond the first cell 16 while remaining in front of the second cell 17. This gives rise to the signal $c_2$ on its own, with the signal $c_1$ going off. So long as the trolley continues to be moved in the same direction, its front end will next engage the gate 14 and open it until it is fully open and the switch 24 delivers a signal P. With the trolley continuing to move forwards, its rear right wheel is initially detected by the first cell 16 which again produces the signal $c_1$ on its own, then both cells detect the wheel giving rise to the combination of signals $c_1+c_2$, and then only the second cell 17 detects the wheel, giving rise to the signal $c_2$ on its own.

Providing the user continues to push the trolley into the storage area, the rear of the trolley will pass the gate 14 which then closes so that the switch 24 returns to generating the signal $\overline{P}$. Providing the above-described normal sequence of signals has been followed, the control circuit C instructs the dispenser D to dispense a ticket, which is represented by the letter T in FIG. 6. The system then returns to its initial rest condition to await the return of another trolley, as shown by the letters RAZ (return to zero) in FIG. 6.

A person returning a trolley may insert it far enough for the front wheel pass the cells 16 and 17, and then withdraw the trolley before the gate 14 has been opened. In this case, the front right wheel of the trolley passes the cells 17 and 16 in reverse order giving rise to a reverse sequence of signals $c_2$, $c_2+c_1$, $c_1$. Under these circumstances, the system is simply returned to zero by the signal processing circuit C.

In contrast, if a person pushes the trolley far enough both to open the gate 14 and to cause the rear wheel of the trolley to pass the cells 16 and 17, and then withdraws the trolley so that the rear wheel goes back past the cells 16 and 17 in the reverse direction, the signal processing circuit C receives the reverse sequence of signals $c_2$, $c_2+c_1$, $c_1$ at a later point in the normal sequence, and in this case it raises an alarm A (represented by a in FIG. 6). If the person then leaves the trolley in a position where it holds the gate open, the alarm continues for as long as the gate remains open. However, if the person then withdraws the trolley far enough for the gate 14 to close, the signal processing circuit C will receive the signal $\overline{P}$. This will cause it raise the alarm as shown by the letter a but to stop the alarm after a few seconds, as shown by the letters RAZ.

A further possibility is that a person arrives without a trolley and opens the gate 14 to remove a trolley from the storage area. In this case the circuit C receives the following signal sequence: P, $c_2$, $c_2+c_1$, $c_1$: and raises the alarm A. If the gate is then closed, the control circuit C receives the signal $\overline{P}$ the alarm will still be raised, but it will be stopped after a few seconds and the sytem reset to zero. The functions performed by the control circuit C are simple functions and may be implemented without difficulty by a person skilled in the art of using logic circuits.

The housing 21 is fixed to the ground in the manner shown in FIGS. 1 and 2 in order to prevent a person returning a trolley from putting a foot between the rear wheels of the trolley while they are going past the cells 16 and 17. The housing is much narrower than the spacing between the back or the front wheels so that it does not get in the way of a trolley being returned.

Naturally it would be possible to replace the photocells 16 and 17 with other types of detector. It would also be possible for the detectors (whether photocells or otherwise) to be disposed to detect the passage of two members of the trolley other than its front and rear wheels.

It is clear that the essential advantages of the invention lie in its simplicity, with a detector system comprising only two detectors, and in the high degree of security it provides against the attempted fraud of obtaining a plurality of rewards without returning a corresponding number of trolleys.

In a variant of the invention, the detectors are placed further forwards as shown at 16' and 17' in FIG. 1. They are placed so that the front of a trolley being returned opens the gate 14 far enough to generate the gate-open signal P before any trolley detection signals are generated by the detectors 16' and 17'. Since trollies usually have front wheels that are slightly behind the foremost portion of the trolley, this means that the normal position for the detectors 16' and 17' will be vertically below the gate 14, or thereabouts.

Figure 7:
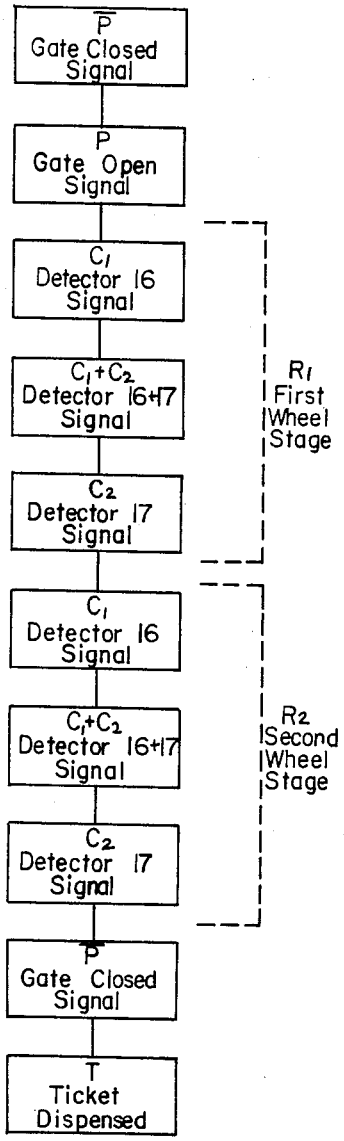
FIGS. 7 and 8 are flow charts for a variant of the system.

In this arrangement, the passage of a trolley through the entrance will give rise to the sequence of signals shown in FIG. 7. A returning trolley will initially open the gate 14 thereby changing the gate signal from $\overline{P}$ to P. Then the front wheel will give rise to a first forward sequence of signals $c_1$, $c_1+c_2$, $c_2$ indicating that a front wheel of the trolley has passed the detectors 16' and 17'. The control circuit C will then receive a second forward sequence $c_1$, $c_1+c_2$, $c_2$ indicating that a back wheel of the trolley has passed the detectors 16' and 17', followed by the signal $\overline{P}$ indicating that the gate 14 has closed behind the trolley. The control circuit C then instructs the ticket dispenser to dispense a ticket, as indicated by the letter T in FIG. 7. The stages corresponding to the first wheel and to the second wheel are indicated by the references $R_1$ and $R_2$ in FIG. 7.

This variant of the invention makes it possible for a plurality of tickets to be dispensed when a group of trolleys are returned together as a single nested block. It is customary for such trolleys to be nested when not in use.

Figure 8:
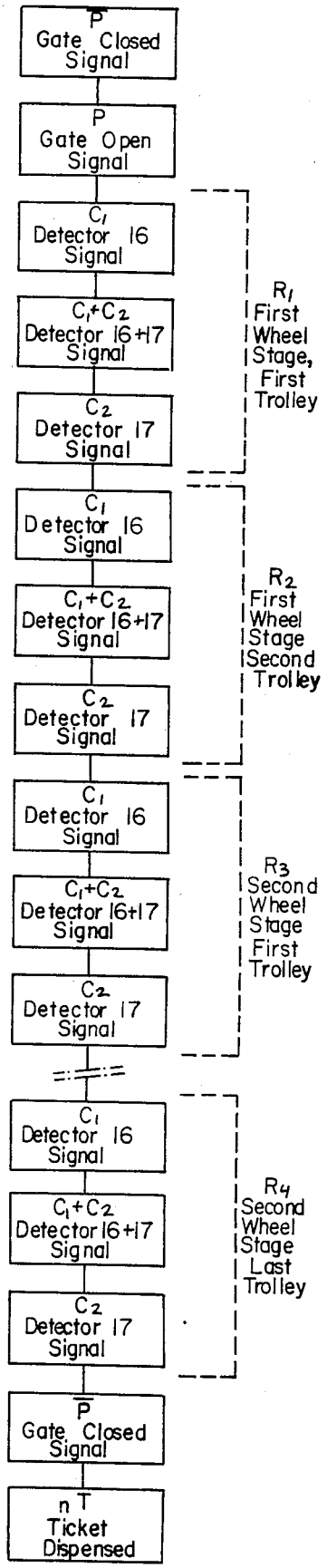

In such a case, the control circuit C receives a sequence of signals as shown in FIG. 8. When n trollies are nested in a single group that is returned as a block, the gate 14 is opened by the front of the leading trolley and the control circuit sees the signal $\overline{P}$ change to P as before. Thereafter the front wheel of the leading trolley passes the detectors 16' and 17' to give rise to a first forward sequence $c_1$, $c_1+c_2$, $c_2$, which is marked as $R_1$ in FIG. 8. The front wheel of the second trolley then passes the detectors to give rise to a second forward sequence $c_1$, $c_1+c_2$, $c_2$ marked as $R_2$ in FIG. 8. Then the back wheel of the leading trolley passes the detectors giving rise to a third forward sequence $R_3$.

The remaining wheels of the group of trollies all pass the detectors 16' and 17' such that the rear wheels of the last trolley give rise to the 2n-th forward sequence $R_{2n}$. After the last trolley has been pushed into the storage area, the gate 14 closes and the control circuit C sees the gate signal return to $\overline{P}$. The control circuit then causes the ticket dispenser to dispense n tickets, as indicated by nT in FIG. 8.

In order to do this, the control circuit C may either be arranged to count the number of forward sequences $R_1$, $R_2$, etc., and then divide the total by two to obtain the number of tickets to be dispensed, or alternatively, the control circuit may be arranged to count the number of pairs of forward sequences (ie. only count even numbered sequences $R_2$, $R_4$, etc.) and then cause the same number of tickets to be dispensed as pairs of forward sequences have been counted. In either case the control circuit causes tickets to be dispensed only after the gate 14 has shut behind the last trolley, and only if it has received an even number of forward sequences.

Figure 9:
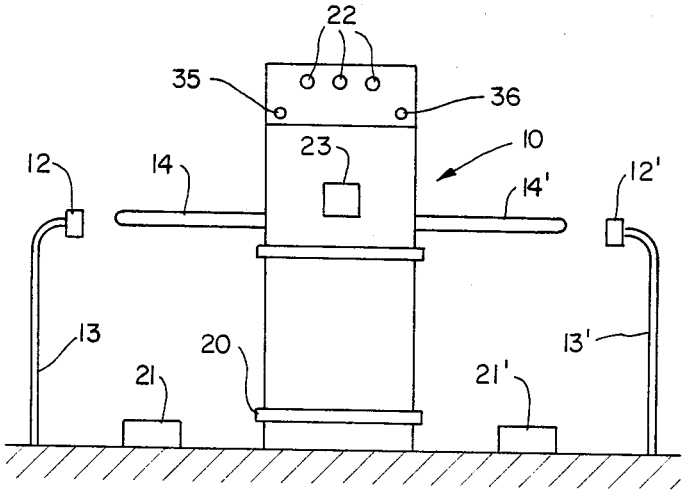
FIG. 9 is a diagram of another variant of the system.

In a further variant of the invention, shown in FIG. 9, the system is symmetrically arranged on either side of the pillar 10. In this case, the left hand side of the system is identical to the system shown in FIGS. 1 and 2, while the right hand side is symmetrical thereto; ie. it has a gate 14' associated with horizontal guide rails 12' mounted on posts 13' to define a trolley return path. The right hand side of the system has detectors identical to those on the left hand side. The control circuit C is responsive to signals from both sides of the system, ie. from both sets of detectors and from both gates. It controls a single ticket dispenser having a single slot 23 in the pillar 10 to dispense tickets corresponding to trollies returned via either side of the system. If trollies are returned substantially simultaneously via both sides, two tickets will be dispensed one after the other via the same slot 23. Appropriate means, such as lamps 35 and 36, may be provided to indicate which passage (left or right) corresponds to which ticket.

A housing 21' should be fixed to the ground in the right hand passage to serve the same purpose as the housing 21, or else such housings can be omitted altogether if the extra protection they provide is considered inessential.

What is claimed is:

1. A system for encouraging users to return vehicles such as trolleys to a vehicle storage area having an entrance fitted with said system by dispensing a reward if a vehicle is effectively returned, while preventing said reward from being dispensed in the event of an attempted fraud or removal of a vehicle from said storage area via said entrance thereto, said system comprising first and second detectors disposed along a vehicle return path at said entrance, said detectors being spaced relative to each other so as to be capable of responding to two members of a vehicle as said vehicle is moved along said path past said detectors, said two members comprising a front member and a rear member which are spaced along said vehicle in the direction of vehicle movement by a distance which is greater than the distance separating the detectors, said movement of said vehicle past said detectors being made in the following sequence:

(a) said first detector only;

(b) said first detector and said second detector simultaneously; and, (c) said second detector only and means to apply vehicle-detection signals from said detectors to a processor circuit connected to control the dispensing of said rewards.

2. A system according to claim 1, including an automatic gate at said entrance to the storage area, said gate being arranged to be opened by a vehicle as it enters said storage area and to close automatically behind a vehicle once it has been returned, said gate being associated with a switch to produce a gate-open signal representative of said gate being open, wherein said gate is dispensed downstream from said detectors in the direction of vehicle movement into said storage area at a distance such that said gate-open signal is produced after initial direction of the gate-opening vehicle.

3. A system according to claim 2, wherein the gate is so disposed relative to said detectors that it is opened by the vehicle after said vehicle front member has passed the detectors and before said vehicle rear member has passed them.

4. A system according to claim 1, including an automatic gate at said entrance to the storage area, said gate being arranged to be opened by the vehicle as it enters said storage area and to close automatically behind the vehicle once it has been returned, said gate being associated with a switch to produce a gate-open signal representative of said gate being open, wherein said gate is disposed substantially level with said detectors in the direction of vehicle movement into said storage area such that said gate-open signal is produced before a initial detection of the gate-opening vehicle.

5. A system according to claim 4, capable of receiving a nested line of vehicles in a single block and of dispensing a reward proportional to the number of vehicles returned in said block.

6. A system according to claim 1, wherein said detectors are placed low above the ground and are suitable for responding to the wheels of the vehicle being returned, the horizontal distance between the detectors being less than the width of said wheels at the height of the detectors.

7. A system according to claim 1, wherein the detectors are send/receive photoelectric cells.

8. A system according to claim 1, including an obstacle placed on the ground at the entrance to the vehicle storage area, said obstacle serving to prevent the person returning a vehicle from putting a foot under the vehicle level with the detectors.

9. A system according to claim 8, wherein said obstacle is a housing fixed to the ground and having means level with said detectors to enhance the condition representative of the absence of an intervening member of the vehicle.

10. A system according to claim 1, comprising a central pillar provided with an automatic gate on either side thereof projecting into respective vehicle return passages, said passages being delimited by said pillar and by guides placed at a suitable distance therefrom, said detectors, control circuit, and means for dispensing a reward being housed in said pillar.

* * * * *